US011656063B2

(12) United States Patent
Doiron et al.

(10) Patent No.: US 11,656,063 B2
(45) Date of Patent: May 23, 2023

(54) REDUCED-ENERGY CARTRIDGE WITH EXTERIOR SEALING MEMBER FOR FLUTED CHAMBER

(71) Applicant: General Dynamics OTS—Canada, Inc., Repentigny (CA)

(72) Inventors: Martin Doiron, Repentigny (CA); Richard Dion, Repentigny (CA); Julien Gagné, Repentigny (CA); Sylvain Dionne, Repentigny (CA)

(73) Assignee: General Dynamics OTS—Canada, Inc., Repentigny (CA)

( * ) Notice: Subject to any disclaimer, the term of this patent is extended or adjusted under 35 U.S.C. 154(b) by 0 days.

(21) Appl. No.: 16/949,748

(22) Filed: Nov. 12, 2020

(65) Prior Publication Data

US 2022/0146238 A1 May 12, 2022

(51) Int. Cl.

| | |
|---|---|
| ***F42B 5/02*** | (2006.01) |
| ***F42B 14/06*** | (2006.01) |
| ***F41A 21/24*** | (2006.01) |

(52) U.S. Cl.

CPC ..... *F42B 5/02* (2013.01); *F41A 21/24* (2013.01); *F42B 14/067* (2013.01)

(58) Field of Classification Search

CPC .. F42B 5/045; F42B 5/02; F42B 5/285; F42B 5/067; F42B 14/06; F42B 14/067; F42B 8/02; F42B 8/04; F42B 8/10

See application file for complete search history.

(56) References Cited

U.S. PATENT DOCUMENTS

| | | | | | |
|---|---|---|---|---|---|
| 3,019,733 | A | | 2/1962 | Braid | |
| 3,292,538 | A | * | 12/1966 | Umbach | F42B 5/30 102/444 |
| 3,363,562 | A | * | 1/1968 | Umbach | F42B 5/30 102/467 |
| 4,798,144 | A | | 1/1989 | Apholt | |
| 5,187,323 | A | * | 2/1993 | Saxby | F42B 6/10 102/440 |

(Continued)

FOREIGN PATENT DOCUMENTS

| | | | | |
|---|---|---|---|---|
| AU | 2020230461 A1 | * | 8/2021 | F42B 12/34 |
| CA | 2061155 C | * | 7/2003 | F42B 6/10 |

(Continued)

*Primary Examiner* — Jonathan C Weber

(74) *Attorney, Agent, or Firm* — LKGlobal | Lorenz & Kopf LLP

(57) ABSTRACT

A reduced-energy cartridge for a chamber of a firearm includes a case and a sabot. The sabot is moveably attached to the case and supported for movement relative to the case from an unfired position to a fired position resulting from combustion within the combustion chamber. The cartridge further includes a sealing member that projects radially outward from the longitudinal axis and from the sabot. The sealing member defines a blowback boundary where the cartridge is configured to seal against an inner surface of the chamber of the firearm. A forward area of the cartridge and a rear area of the cartridge are separated by the blowback boundary. The sealing member is configured for releasably sealing against the inner surface of the chamber to regulate pressure at the forward area resulting from combustion within the combustion chamber.

18 Claims, 5 Drawing Sheets

(56) References Cited

U.S. PATENT DOCUMENTS 5,359,937 A * 11/1994 Dittrich ..... F42B 14/064 102/444
5,492,063 A * 2/1996 Dittrich ..... F42B 5/02 102/444
5,677,505 A * 10/1997 Dittrich ..... F42B 5/02 102/444
5,700,972 A * 12/1997 Saxby ..... F41B 11/62 102/440
5,962,805 A * 10/1999 Saxby ..... F41B 11/721 124/75
6,095,051 A * 8/2000 Saxby ..... F42B 5/02 102/440
6,202,533 B1 3/2001 Miller et al.
6,415,718 B1 * 7/2002 Saxby ..... F42B 5/105 102/446
6,422,149 B1 * 7/2002 Saxby ..... F42B 8/02 102/446
6,439,123 B1 * 8/2002 Dionne ..... F42B 5/02 102/444
6,564,719 B2 * 5/2003 Saxby ..... F42B 8/02 102/446
6,575,098 B2 * 6/2003 Hsiung ..... F42B 5/02 102/498
7,287,475 B2 10/2007 Brunn
7,658,138 B2 2/2010 Beckmann et al.
7,814,836 B2 * 10/2010 Saxby ..... F42B 8/04 102/447
8,327,767 B2 * 12/2012 Lafortune ..... F42B 8/02 102/446
8,365,669 B1 * 2/2013 Saxby ..... F42B 5/045 102/470
8,485,102 B2 * 7/2013 Carlson ..... F42B 5/045 102/370
8,539,885 B2 9/2013 Huffman
8,616,129 B1 12/2013 Barrow et al.
8,640,621 B2 2/2014 Broden et al.
8,783,152 B2 2/2014 Broden et al.
8,925,463 B1 1/2015 Horacio
8,938,903 B2 1/2015 Larue
9,273,941 B2 * 3/2016 Carlson ..... F42B 5/045
9,453,713 B1 9/2016 Langner
9,470,492 B2 * 10/2016 Carlson ..... F42B 8/16
9,476,681 B2 * 10/2016 Saxby ..... F42B 5/045
9,494,397 B2 * 11/2016 Carlson ..... F42B 12/76
9,534,877 B2 * 1/2017 Huffman ..... F42B 8/02
9,651,346 B2 * 5/2017 Carlson ..... F42B 5/045
9,835,426 B2 * 12/2017 Carlson ..... F42B 8/16
10,088,287 B2 * 10/2018 Carlson ..... F42B 8/16
10,436,560 B2 * 10/2019 Carlson ..... F42B 33/00
2002/0162475 A1 * 11/2002 Saxby ..... F42B 5/02 102/446
2010/0269724 A1 * 10/2010 Head ..... F42B 5/045 102/447
2011/0252999 A1 * 10/2011 Carlson ..... F42B 12/40 102/513
2012/0192751 A1 * 8/2012 Lafortune ..... F42B 5/045 102/439
2013/0047881 A1 * 2/2013 Saxby ..... F42B 8/02 102/444
2014/0311332 A1 * 10/2014 Carlson ..... F41A 5/18 89/191.01
2014/0318402 A1 * 10/2014 Carlson ..... F42B 12/76 102/524
2014/0373745 A1 * 12/2014 Carlson ..... F42B 12/74 102/502
2016/0356585 A1 * 12/2016 Carlson ..... F42B 8/16
2017/0108317 A1 * 4/2017 Carlson ..... F41A 5/18
2017/0299360 A1 * 10/2017 Carlson ..... F42B 5/145
2018/0164084 A1 * 6/2018 Carlson ..... F42B 12/76
2020/0011643 A1 * 1/2020 Carlson ..... F42B 33/00
2021/0270587 A1 * 9/2021 Lafortune ..... F42B 14/064
2021/0381812 A1 * 12/2021 Braun ..... F42B 5/03

FOREIGN PATENT DOCUMENTS

CA 2340424 C * 10/2007 ..... F42B 5/02
CA 2382542 C * 12/2008 ..... F42B 5/02
CA 2796015 A1 * 10/2011 ..... F42B 12/40
CA 2749624 A1 * 2/2013 ..... F41A 19/13
CA 2621708 C * 4/2013 ..... F42B 5/045
CA 2857576 A1 * 6/2013 ..... F42B 12/40
CA 2749624 C * 9/2018 ..... F41A 19/13
CA 2796015 C * 3/2019 ..... F42B 12/40
CN 1043925 C * 6/1999 ..... F41B 11/62
CN 1351702 A * 5/2002 ..... F41A 23/20
CN 100347514 C * 11/2007 ..... F42B 5/02
DE 4016001 A1 11/1991
EP 499332 A1 * 8/1992 ..... F42B 6/10
EP 1079199 A2 * 2/2001 ..... F42B 8/02
EP 1228342 B1 * 7/2003 ..... F42B 5/02
EP 1104541 B1 * 3/2004 ..... F42B 5/02
EP 1712873 A1 10/2006
EP 1962048 A2 * 8/2008 ..... F42B 5/045
ES 2352876 T3 * 2/2011 ..... F42B 5/02
GB 2281118 A * 2/1995 ..... F41B 11/62
GB 2340587 A * 2/2000 ..... F42B 5/02
GB 2353584 A * 2/2001 ..... F42B 8/02
GB 2446600 A * 8/2008 ..... F42B 5/045
GB 2470421 A * 11/2010 ..... F42B 5/045
NO 330100 B1 * 2/2011 ..... F42B 5/02
RU 2134399 C1 * 8/1999 ..... F41B 11/62
WO WO-9505573 A1 * 2/1995 ..... F41B 11/62
WO WO-0009965 A1 * 2/2000 ..... F42B 5/02
WO WO-0063633 A1 * 10/2000 ..... F41A 23/20
WO WO-0116550 A1 * 3/2001 ..... F42B 5/02
WO WO-0218866 A2 * 3/2002 ..... F42B 5/02
WO WO-2011130550 A2 * 10/2011 ..... F42B 12/40
WO WO-2013082557 A1 * 6/2013 ..... F42B 12/40
WO WO-2013109634 A1 * 7/2013 ..... F42B 10/26
WO WO-2014144104 A2 * 9/2014 ..... F41A 3/26
WO WO-2014144104 A3 * 12/2014 ..... F41A 3/26
WO WO-2018083680 A1 * 5/2018 ..... F41B 11/62
WO WO-2020176970 A1 * 9/2020 ..... F42B 12/34

* cited by examiner

REDUCED-ENERGY CARTRIDGE WITH EXTERIOR SEALING MEMBER FOR FLUTED CHAMBER

TECHNICAL FIELD

The following generally relates to a cartridge for a firearm and, more particularly, relates to a reduced-energy cartridge with an exterior sealing member for a firearm with a fluted chamber.

BACKGROUND

Firearm cartridges are available in a wide variety of configurations. Some are configured for blowback operation. Usually, in configurations that rely on blowback operation, the breech is not locked mechanically at the time of firing. Once open, the cartridge or cartridge case is ejected.

The cartridge should perform reliably during such operations. Specifically, the casing should be well-supported in the chamber during firing. As such, pressure in the chamber can be effectively applied for both driving the projectile out of the barrel and for recoiling the bolt assembly.

However, conventional cartridges suffer from various limitations and/or deficiencies. For example, the material of the casing may be relatively expensive and/or the material may be relatively heavy. Other materials may not possess needed characteristics (e.g., thermal expansion characteristics) for reliable operation.

Also, some cartridges may include features that intentionally limit energy and speed of the projectile. The features of these so-called reduced-energy cartridges may, however, offset the balance of pressures necessary for effectively projecting the projectile and ejecting the ignited cartridge due to blowback.

Moreover, some cartridges may be ill-suited for firearms with chambers that include surface features. For example, fluting in the chamber may negatively offset the balance of pressures necessary for blowback operation of some cartridges.

Accordingly, it is desirable to provide an improved cartridge, such as a reduced-energy cartridge for a firearm that reliably provides blowback operation, even in a fluted chamber. Furthermore, it is desirable to provide a cartridge with materials that are lower cost, lighter in weight, etc. as compared to standard materials. Moreover, it is desirable to provide a cartridge that robustly supports a projectile to bring it up to the desired speed and energy (including for reduced-energy configurations) and that also reliably ejects from the chamber in a blowback operation. Furthermore, other desirable features and characteristics of the various embodiments described herein will become apparent from the subsequent detailed description and the appended claims, taken in conjunction with the accompanying drawings and this background.

SUMMARY

A reduced-energy cartridge for a chamber of a firearm is disclosed. The cartridge includes a case and a sabot with a first end and a second end that are separated along a longitudinal axis. The first end is attached to the case to cooperatively define an internal combustion chamber with the case. The sabot is moveably attached to the case and supported for movement relative to the case from an unfired position to a fired position resulting from combustion within the combustion chamber. The second end extends from the case along the longitudinal axis in the unfired and fired positions. The cartridge further includes a sealing member that is provided on the second end of the sabot. The sealing member projects radially outward from the longitudinal axis and from the sabot. The sealing member defines a blowback boundary where the cartridge is configured to seal against an inner surface of the chamber of the firearm, wherein a forward area of the cartridge and a rear area of the cartridge is separated by the blowback boundary. The sealing member is configured for releasably sealing against the inner surface of the chamber to regulate pressure at the forward area resulting from combustion within the combustion chamber.

Furthermore, a method of manufacturing a reduced-energy cartridge for a chamber of a firearm is disclosed according to example embodiments. The method includes attaching a first end of a sabot to a case to cooperatively define an internal combustion chamber with the case, including moveably attaching the sabot to the case and supporting the sabot for movement relative to the case from an unfired position to a fired position. The sabot includes a second end that is separated from the first end along a longitudinal axis. The second end extends from the case along the longitudinal axis in the unfired and fired positions. The method also includes providing a sealing member on the second end of the sabot. The sealing member projects radially outward from the longitudinal axis and radially outward from the sabot. The sealing member defines a blowback boundary where the cartridge is configured to seal against an inner surface of the chamber of the firearm. A forward area of the cartridge and a rear area of the cartridge are separated by the blowback boundary. The sealing member is configured for releasably sealing against the inner surface of the chamber to regulate pressure at the forward area resulting from combustion within the combustion chamber.

Moreover, a reduced-energy cartridge for a fluted chamber of a firearm is disclosed according to example embodiments. The cartridge includes a case and a sabot. The sabot includes a first end and a second end that are separated along a longitudinal axis. The sabot includes a combustion passage extending longitudinally between the first end and the second end. The first end is attached to the case to cooperatively define an internal combustion chamber with the case. The first end is supported for movement relative to the case from an unfired position to a fired position resulting from combustion within the combustion chamber. The second end extends from the case along the longitudinal axis in the unfired and fired positions. The second end has a frustoconic datum taper. Also, the cartridge includes a sealing member that is provided on the second end. The sealing member projects radially outward from the longitudinal axis and radially outward from the sabot. The sealing member defines a blowback boundary where the cartridge is configured to seal against a fluted inner surface of the chamber of the firearm. A forward area of the cartridge and a rear area of the cartridge are separated by the blowback boundary. The sealing member is configured for releasably sealing against the fluted inner surface of the chamber to regulate pressure at the forward area resulting from combustion within the combustion chamber.

BRIEF DESCRIPTION OF THE DRAWINGS

The various embodiments will hereinafter be described in conjunction with the following drawing figures, wherein like numerals denote like elements, and wherein.

DETAILED DESCRIPTION

The following Detailed Description is merely exemplary in nature and is not intended to limit the various embodiments or the application and uses thereof. Furthermore, there is no intention to be bound by any theory presented in the preceding background or the following detailed description.

Various embodiments contemplated herein relate to cartridges (e.g., reduced-energy cartridges) for firearms that are configured for blowback operation. In some embodiments, these cartridges may be used as training ammunition for firing relatively low-mass projectiles. Cartridges of the present disclosure may include one or more features that improve cycling of a weapon (the action of expelling spent cartridges (or casings) from a firearm and subsequently loading a fresh round into the firing chamber) while maintaining performance of the projectile (e.g., maintaining energy to the projectile and projectile speed to within predetermined limits).

Figure 1:
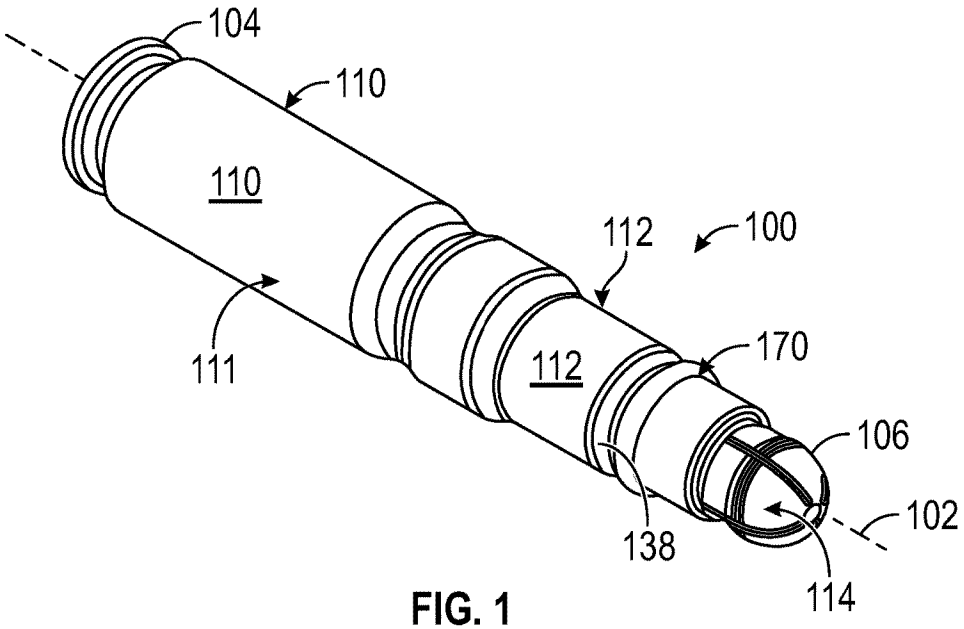
FIG. 1 is an isometric view of a reduced-energy cartridge with a sealing member according to example embodiments of the present disclosure.

Referring initially to FIG. 1, a cartridge 100 for a firearm is illustrated according to example embodiments of the present disclosure. The cartridge 100 may be of any suitable caliber. The cartridge 100 may also be configured in different ways for different firearms. It will be appreciated that the term "firearm" is used generally herein to mean any weapon suitable for firing the cartridge 100, including, but not limited to, a handgun, long gun, rifle, shotgun, carbine, machine gun, submachine gun, etc. Also, the cartridge 100 may be configured for firearms, including but not limited to those that are single-shot, repeating-action, semi-automatic or select-fire/fully automatic. In some embodiments, for example, the cartridge 100 may be configured as a 7.62×51 mm NATO cartridge and for firearms that are configured for such cartridges.

Generally, the cartridge 100 may define a longitudinal axis 102 that extends between an aft end 104 and a forward end 106. It will be appreciated that a forward direction is defined along the axis 102 from the aft end 104 toward the forward end 106. On the contrary, a rearward direction is defined along the axis 102 from the forward end 106 toward the aft end 104.

Also, the cartridge 100 may include a casing 111 and a projectile 114, which is removably attached to the casing 111. However, it will be appreciated that the cartridge 100 of the present disclosure may include the casing 111 (and propellant therein) and that the projectile 114 may be omitted (e.g., when the cartridge 100 is configured as a blank).

The casing 111 may include a case 110 and a sabot 112. The case 110 may be disposed at the aft end 104, and the projectile 114 may be disposed at the forward end 106. The sabot 112 may be disposed longitudinally between the case 110 and the projectile 114. The sabot 112 may be moveably attached (e.g., slidably attached) to the case 110, and the sabot 112 may be removably attached to the projectile 114.

Figure 2:
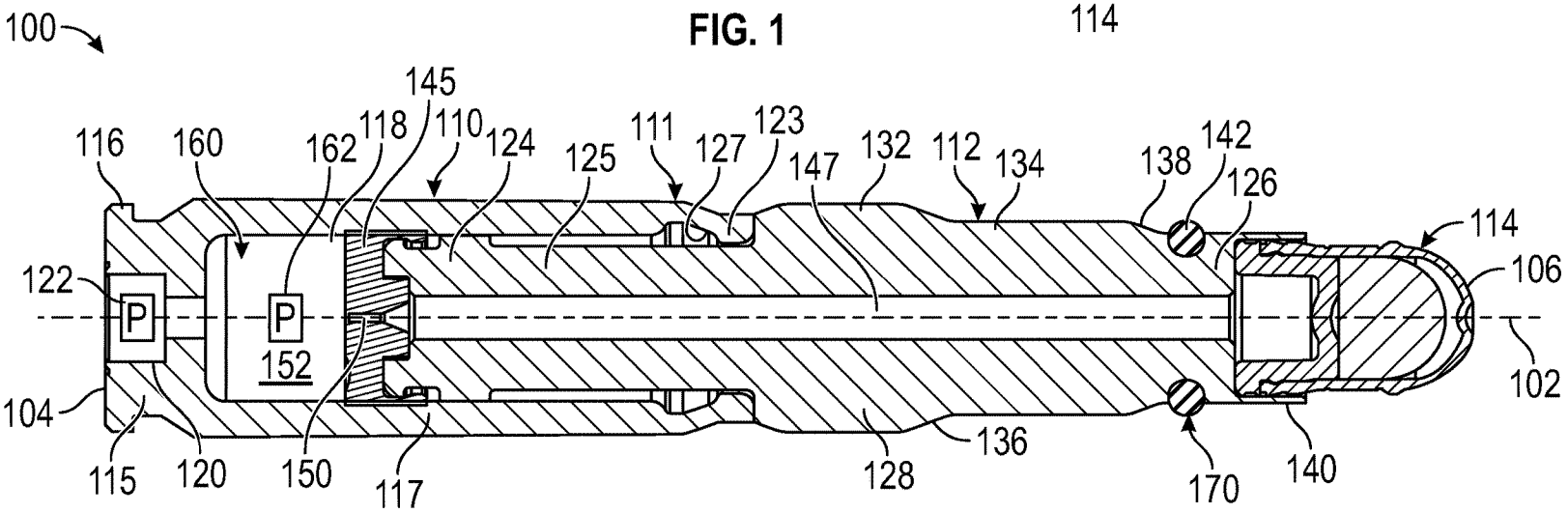
FIG. 2 is a longitudinal cross-sectional view of the cartridge of FIG. 1 shown in an unfired position.

As shown in FIG. 2, the case 110 may be cylindrical and hollow with one substantially closed end and one open end. The case 110 may include an end cap 115 at the aft end 104. The end cap 115 may include a radially-projecting (flange-like) rim 116. The end cap 115 may also include a primer cap opening 120 that is centered on the axis 102. The case 110 may also include a hollow side wall 117 that is centered about the axis 102 and that projects from the end cap 115 along the axis 102. As such, the side wall 117 and end cap 115 cooperatively define an internal cavity 118 of the case 110. The side wall 117 may include a terminal end 123 with an outer diameter area that tapers downward in radius and an inner diameter area with an annular groove 127. The case 110 may be made from an aluminum-based material (e.g., aluminum or an aluminum alloy) in some embodiments; however, it will be appreciated that the case 110 may be made out of another material without departing from the scope of the present disclosure.

The sabot 112 may be elongate and cylindrical with a first end 124 and a second end 126 that are separated along the axis 102. Furthermore, the sabot 112 may include a central passage 147 that is centered on the axis 102 and that extends continuously through the sabot 112 from the first end 124 to the second end 126. The sabot 112 may include a shaft portion 125 disposed forward of the first end 124 and having a smaller radius than the rest of the sabot 112. The shaft portion 125 may slide within the terminal end of the case 110. The sabot 112 may additionally include a central longitudinal portion 128 with an annular body 132 having a larger radius than the rest of the sabot 112 and a forward body 134 with a comparably smaller radius. The forward body 134 may be disposed closer to the forward end 106, and the annular body 132 may be disposed closer to the aft end 104. The sabot 112 may include a taper 136 that gradually transitions between the annular body 132 and the forward body 134. Additionally, the sabot 112 may include a datum taper 138. The datum taper 138 may taper gradually downward as the datum taper 138 extends longitudinally and transitions from the forward body 134 to the second end 126 of the sabot 112.

Figure 4:
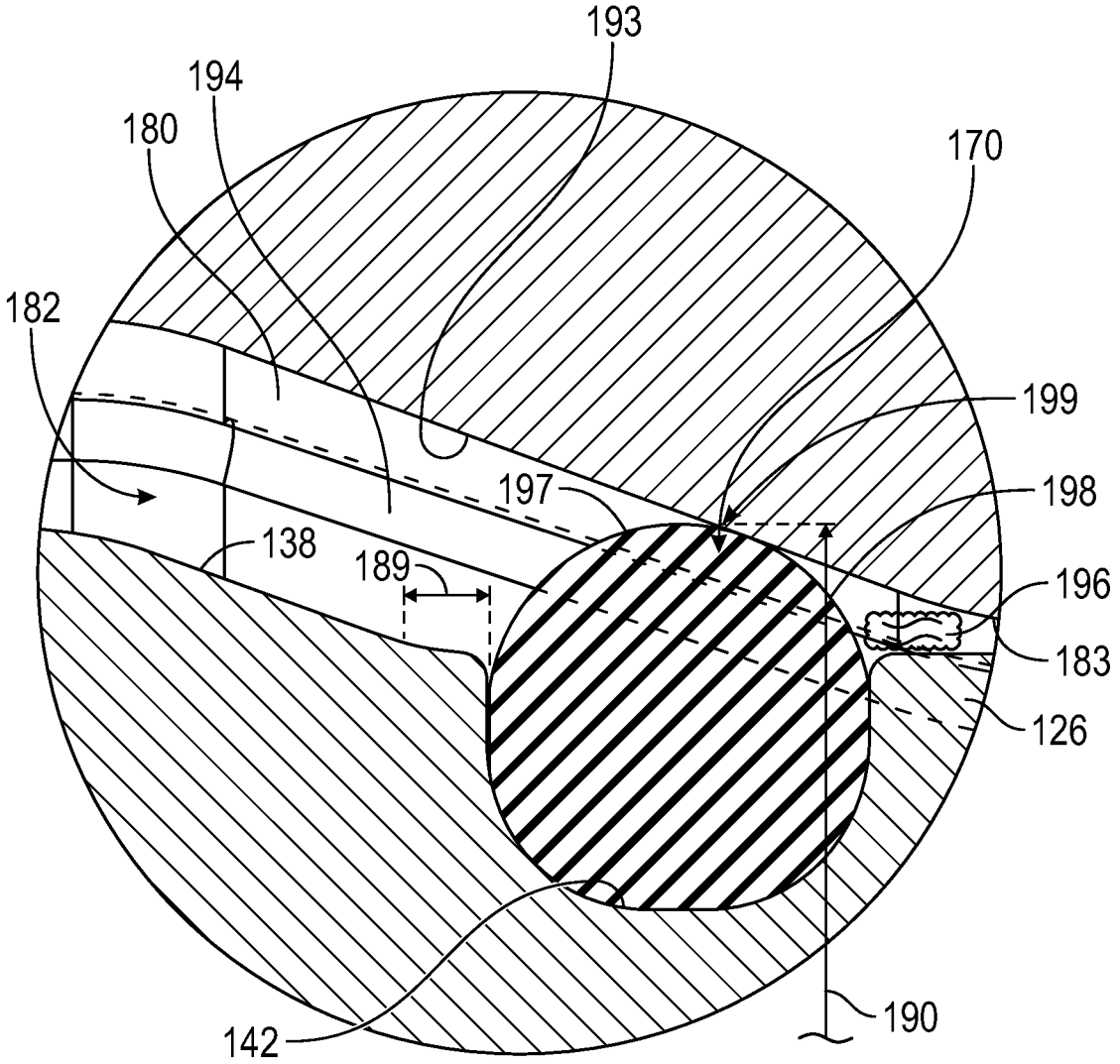
FIG. 4 is a cross-sectional view of a portion of the cartridge and chamber indicated in FIG. 3.

The second end 126 may further include a geometrical groove 142. The groove 142 may be annular in some embodiments, but the geometry of the groove 142 may be configured otherwise without departing from the scope of the present disclosure. The groove 142 may be disposed at a distance 189 from the datum taper 138. In some embodiments, the groove 142 may be disposed forward relative to the datum taper 138 as shown in FIG. 4. In other embodiments, the groove 142 may be disposed rearward relative to the taper 138. Moreover, in some embodiments, the groove 142 may be disposed on the taper 138.

The sabot 112 may further include a longitudinally directed annular flange 140 that defines the terminal portion of the second end 126. The flange 140 may receive the projectile 114 in some embodiments (FIG. 2).

The sabot 112 may define a unitary, one-piece member. The sabot 112 may also be made from and/or include an aluminum-based material (e.g., aluminum or an aluminum alloy) in some embodiments. However, other materials may be used without departing from the scope of the present disclosure.

A sealing disc 145 may be included proximate the first end 124 of the sabot 112. The sealing disc 145 may be fixedly attached to the first end 124, and the sealing disc 145 and first end 124 may include interlocking features, such as corresponding undercut radial surfaces. The sealing disc 145 may include a choke aperture 150 that is centrally located and that is centered on the axis 102. The choke aperture 150 extends through the sealing disc 145 to fluidly connect the combustion chamber 152 and the passage 147. The choke aperture 150 may include an inlet directed toward the aft end 104. The choke aperture 150 may also include an outlet that tapers outward as it extends toward the forward end 106. It will be appreciated that the dimensions of the inlet, the taper of the outlet, and/or other characteristics of the choke aperture 150 may be selected and configured for managing and controlling combustion within the cartridge 100 and for metering the quantity of gases directed to the projectile to control its speed and metering the quantity of gases for recoiling the weapon.

Figure 3:
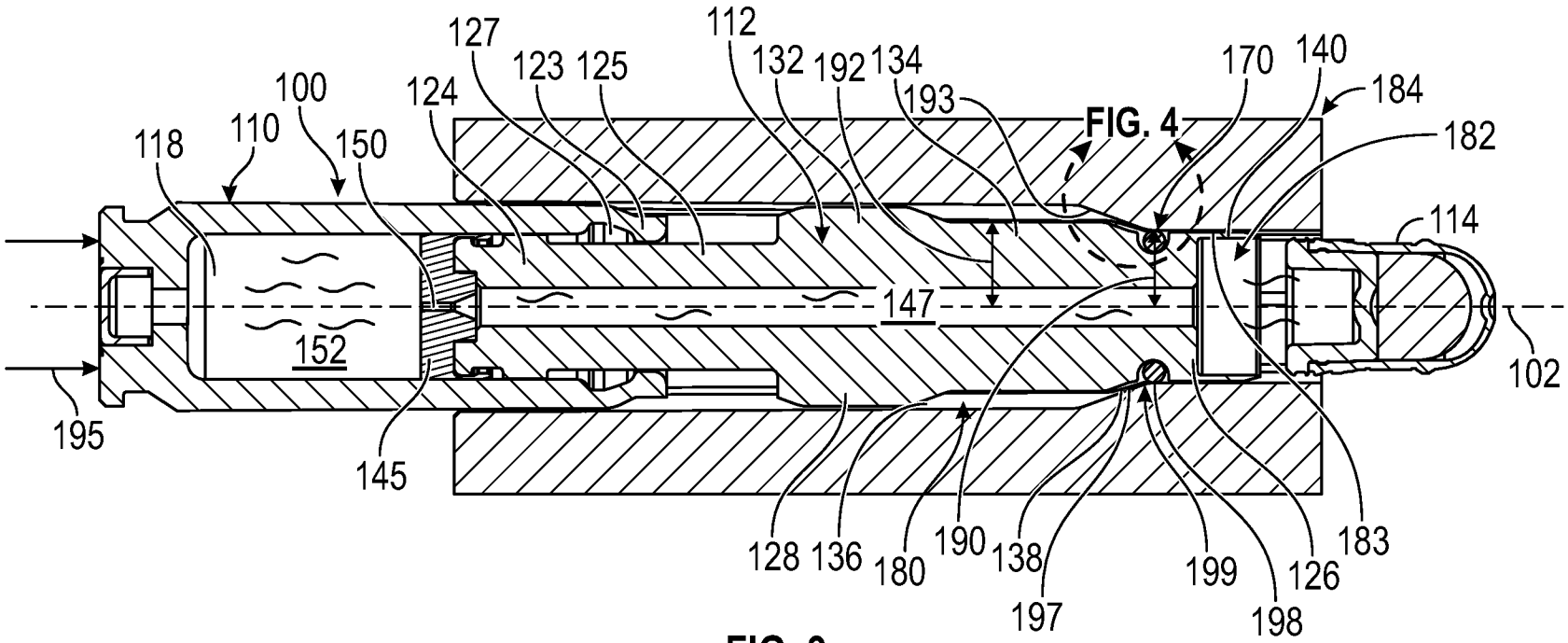
FIG. 3 is a longitudinal cross-sectional view of cartridge of FIG. 1 shown in a chamber of a firearm and shown in a fired position.

The first end 124 of the sabot 112 (including the sealing disc 145) may be received in the case 110. The sealing disc 145 may have an outer diameter disposed at an inner diameter of the case 110 to substantially seal thereto. The sealing disc 145, the first end 124, and the shaft portion 125 of the sabot 112 may be supported for sliding movement within the cavity 118 of the case 110 such that the case 110 and sabot 112 may move telescopingly relative to each other between an unfired position (FIG. 2) and a fired position (FIG. 3). In the unfired position, the terminal end 123 of the case 110 may be disposed adjacent the annular body 132 and the first end 124 may be retracted within the case 110 as represented in FIG. 2. Moving to the fired position represented in FIG. 3, the shaft portion 125 may extend, slide, and project out of the case 110.

The first end 124 of the sabot 112 with the attached sealing disc 145 may cooperate with the case 110 to define an internal combustion chamber 152. As the sabot 112 slides relative to the case 110, the volume of the chamber 152 changes. The volume in the chamber 152 grows as the sabot 112 and case 110 move from the unfired position toward the fired position.

The cartridge 100 may further include a propellant charge 160 (FIG. 2). The propellant charge 160 may include a propellant 162 (gunpowder or cordite) included in the chamber 152. The propellant charge 160 may also include a primer 122 within the primer cap opening 120.

During a firing sequence, the primer 122 may ignite the propellant 162 to telescopingly move the cartridge 100 from the unfired position (FIG. 2) to the fired position (FIG. 3). As represented in FIG. 3, the choke aperture 150 regulates and controls distribution of the pressure that builds through central passage 147 for driving the projectile 114 and bringing the projectile 114 up to velocity as it exits the barrel of the firearm. It will be understood that the telescoping movement of the sabot 112 and case 110 may reduce or limit energy for the projectile 114 as compared to a cartridge with a rigid or fixed casing.

Figure 5:
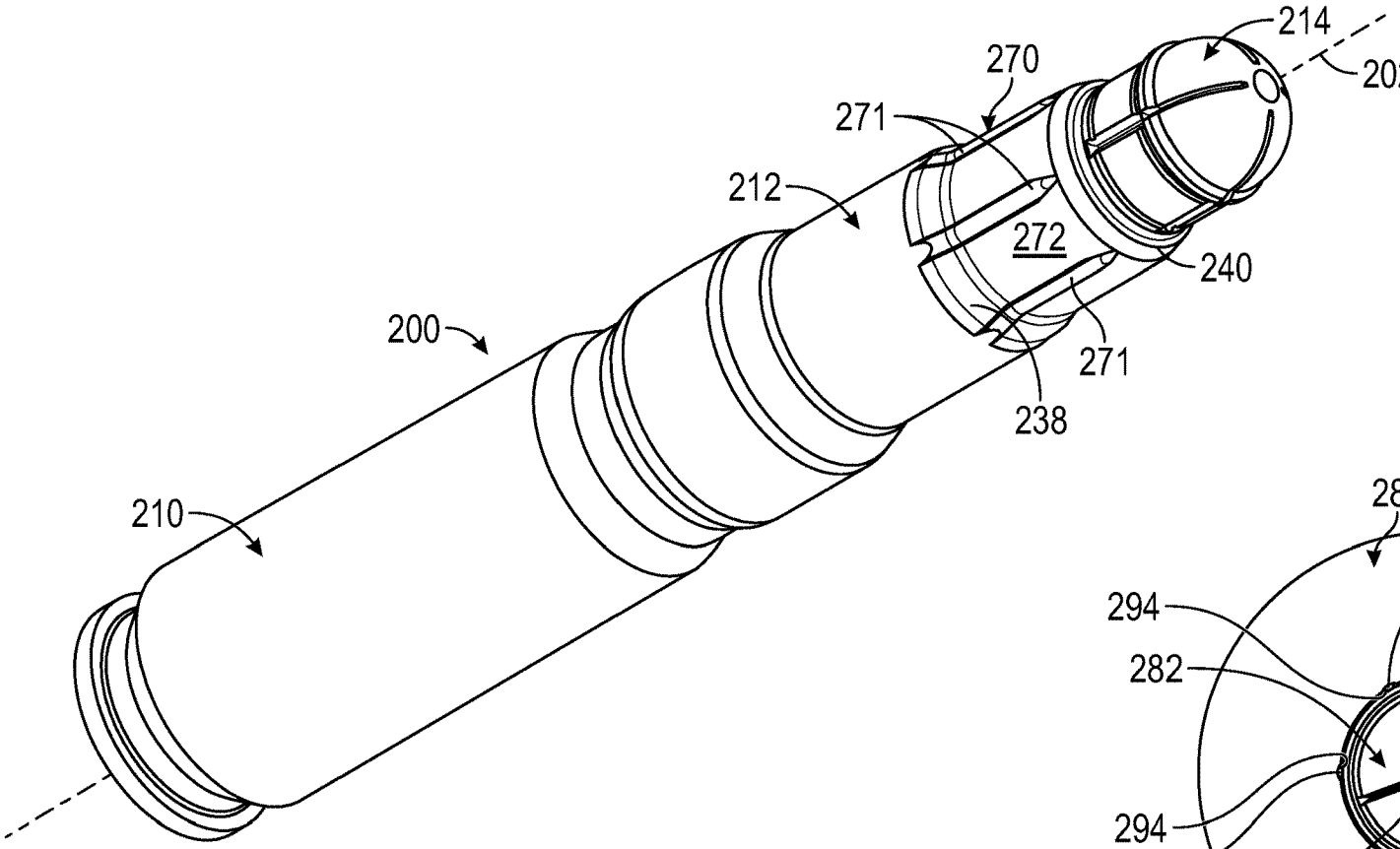
FIG. 5 is an isometric view of the reduced-energy cartridge with a sealing member according to additional example embodiments of the present disclosure.
Figure 6:
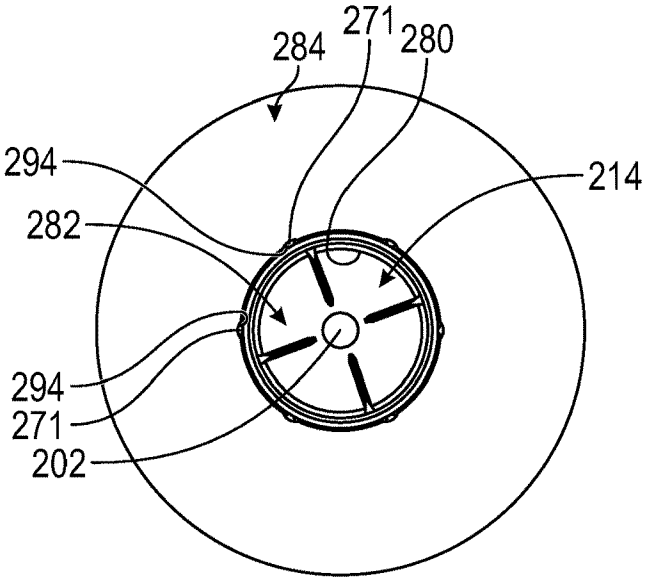
FIG. 6 is an axial cross-section of the cartridge of FIG. 5 shown within a chamber.

The cartridge 100 may further include a sealing member 170. In some embodiments, the sealing member 170 may be an independent part that is removably attached to another part discussed above. For example, as shown in FIGS. 1-4, the sealing member 170 may be a part that is removably attached to the sabot 112. However other embodiments of the sealing member may be integrated into another part. For example, as shown in FIGS. 5-6, the sealing member may be part of the sabot.

As shown in the embodiments of FIGS. 1-4, the sealing member 170 may have a predetermined geometrical shape, such as an annular or toric shape; however, the sealing member 170 may have another shape without departing from the scope of the present disclosure (e.g., the shapes discussed below with reference to FIGS. 5 and 6). The sealing member 170 may be configured for substantially sealing against an inner surface 180 of a chamber 182 of a firearm 184 as will be discussed with reference to FIGS. 3 and 4. The sealing member 170 may have a wide variety of configurations for sealing to the inner surface 180 during action of the firearm. The sealing member 170 may regulate pressures for driving the projectile 114 up to speed and for blowback self-ejection of the case 110 and sabot 112 from the chamber 182.

It will be appreciated that the seal of the sealing member 170 against the inner surface 180 is a temporary seal created during blowback operation. The sealing member 170 provides a seal and gas flow obstruction, thereby creating a significant pressure gradient between a forward area 198 and a rear area 197 of the cartridge 100 (FIGS. 3 and 4) as will be discussed in greater detail below.

The sealing member 170 may have one of a variety of geometrical shapes, such as an annular shape, a toric shape, a toroidal shape, etc. Thus, the sealing member 170 may extend continuously about the axis 102. The sealing member 170 may be centered on the axis 102.

The sealing member 170 may also have a solid cross section. For example, the sealing member 170 may have a solid, circular cross section in some embodiments. However, the sealing member 170 may have another cross sectional shape without departing from the scope of the present disclosure. The sealing member 170 may be constructed from a resilient material. For example, the sealing member 170 may be made from a resilient polymeric material such as nitrile rubber (i.e., Buna-n rubber); however, the sealing member 170 may be made of other materials without departing from the scope of the present disclosure. Accordingly, the sealing member 170 may resiliently flex to provide sealing.

The sealing member 170 may be received and disposed within the continuous, annular groove 142 of the sabot 112. Accordingly, the sealing member 170 may be disposed in a forward direction and spaced apart slightly at a distance 189 from the frustoconic datum taper 138 with respect to the axis 102. In other embodiments, the sealing member 170 may be disposed in a rearward direction from the datum taper 138, or the sealing member 170 may be disposed on the datum taper 138 in further embodiments.

Also, the sealing member 170 may project outward radially from surrounding areas of the outer surface of the sabot 112. As shown in FIGS. 3 and 4, an outer radius 190 of the sealing member 170 may be approximately the same or only slightly larger than an outer radius 192 of the second end 126 of the sabot 112. Thus, the outer radius 190 may be slightly larger than that of the datum taper 138.

As mentioned, the sealing member 170 may be operable and configured to seal against the inner surface 180 of the chamber 182. More specifically, while the cartridge 100 is in the unfired position, the datum taper 138 may nest against an inversely corresponding tapered chamber surface 193 of the inner surface 180 while the sealing member 170 seals against a forward portion 183 of the inner surface 180 of the chamber 182. The diameter of the forward portion 183 may remain substantially constant along its longitudinal length.

In some embodiments, the sealing member 170 may be useful for sealing against a surface feature included on the inner surface 180. For example, in some embodiments, the inner surface 180 may be fluted (i.e., may include one or more flutes 194). The flutes 194 may be shallow grooves that extend primarily in the longitudinal direction along the axis 102. In some embodiments, the flutes 194 may extend straight or tapered in all direction and substantially parallel to the axis 102, and there may be a plurality of flutes spaced apart equally about the axis 102 in a circumferential direction. However, in additional embodiments, the flutes 194 may extend primarily along the axis 102 but also slightly helically about the axis 102.

The flutes 194 may extend along the tapered chamber surface 193 and to the forward portion 183. The sealing member 170 may seal against the uneven, fluted forward portion 183 as represented in FIG. 3. For example, the radial dimensions of the sealing member 170, the resilient flexibility of the sealing member 170, the position of the sealing member 170 relative to the datum taper 138, and/or other characteristics of the sealing member 170 may allow the cartridge 100 to achieve the seal. The sealing member 170 may achieve the balance of pressures for driving the projectile 114 and for blowback of the empty cartridge (i.e., the case 110 and sabot 112 in the fired position).

Operation of the sealing member 170 will now be discussed in greater detail. Assuming the cartridge 100 is in the unfired position of FIG. 2. The cartridge 100 may begin cycling, and in some embodiments, may move from a magazine into the chamber 182. A bolt assembly may apply a forward-directed force (represented by arrows 195 in FIG. 3) on the end cap 115, and the force 195 may be provided by a recoil spring of the bolt assembly in some embodiments. This force 195 may push and substantially seal the sealing member 170 against the fluted forward portion 183 of the inner surface 180. As such, the sealing member 170 may define a blowback boundary 199 of the cartridge 100. The blowback boundary 199 may be defined where the sealing member 170 abuts and seals against the inner surface 180. As such, the forward area 198 of the cartridge 100 and the rear area 197 of the cartridge 100 are separated longitudinally by the blowback boundary 199. It will be appreciated that the blowback boundary 199 may move relative to the inner surface 180 as the cartridge 100 and the sealing member 170 move from the unfired position to the fired position and as the pressures in the chamber 182 change. More specifically, the blowback boundary 199 may move rearward from the forward portion 183 of the inner surface 180 to the tapered chamber surface 193 and further rearward during blowback operations.

The propellant charge 160 may be ignited, generating gas pressure that pushes the projectile 114 out of the barrel. Some of the generated gas pressure in the forward area 198 (represented at 196 in FIG. 4) pushes rearward on the sabot 112. The pressure 196 pushes against the sealing member 170 and back against the sabot 112 and case 110 in the fired position (FIGS. 3 and 4). The pressure 196, therefore, pushes back the bolt carrier assembly, which recoils the firearm, and once the breech is open, the empty cartridge (i.e., the case 110 and sabot 112) eject. Furthermore, a fresh cartridge 100 (in the unfired position) may move into the chamber 182, for example, from the magazine.

The sealing member 170 effectively seals against the inner surface 180 of the chamber 182, even in embodiments where the inner surface 180 is fluted. Also, even in embodiments where the cartridge 100 is a reduced-energy cartridge 100 (i.e., where forces are relatively low), the sealing member 170 provides the proper balance of pressures for bringing the projectile 114 up to the desired speed and for blowback ejection of the empty cartridge.

In addition, embodiments may include a sabot 112 and a case 110 that have relatively low thermal expansion characteristics. For example, as mentioned, the sabot 112 and case 110 may be made of aluminum in some embodiments in order to reduce weight of the cartridge 100 and to reduce material costs. However, it will be appreciated that the sabot 112 and/or case 110 may be made from other materials (e.g., brass, steel, etc.) without departing from the scope of the present disclosure.

The sealing member 170 also provides manufacturing benefits. For example, because of the features discussed above, the cartridge 100 may be manufactured efficiently.

Referring now to FIGS. 5 and 6, the cartridge 200 is shown according to additional embodiments of the present disclosure. The cartridge 200 may be substantially similar to the embodiments discussed above except as noted. Components that correspond to those of FIGS. 1-4 are indicated by corresponding reference numbers increased by 100.

The cartridge 200 may include a case 210, a sabot 212, and a projectile 214. Furthermore, the cartridge 200 may include a sealing member 270. The sealing member 270 may include a plurality of elongate rails 271 (i.e., ribs, spines, ridges, etc.). In some embodiments, there may be six rails 271; however, the cartridge 200 may have any number of rails 271 without departing from the scope of the present disclosure. The rails 271 may be attached to the sabot 212 and may extend longitudinally along the outer surface thereof. In some embodiments, the outer surface of the rails 271 may define a taper. In the illustrated embodiment, the rails 271 extend substantially parallel to the axis 202. Also, the rails 271 may be spaced apart equally about the axis 202 in the circumferential direction.

In some embodiments, the rails 271 of the sealing member 270 may be integrally attached to the sabot 212 so as to define a unitary (i.e., one-piece) body. For example, the sabot 212 and rails 271 may be integrally attached to define a unitary polymeric body (i.e., a polymeric one-piece body). However, it will be appreciated that the body may be made out of different materials without departing from the scope of the present disclosure.

The sealing member 270 may also define intermediate surfaces 272 located circumferentially between neighboring rails 271. The intermediate surfaces 272 may be substantially smooth and the rails 271 may project out radially therefrom. Furthermore, in some embodiments, the rails 271 and/or the intermediate surfaces 272 may extend to the datum taper 238. The rails 271 and/or the intermediate surfaces 272 may additionally extend to the flange 240 of the sabot 212.

As shown in FIG. 6, when the cartridge 200 is disposed in the chamber 282 of the firearm 284, the rails 271 may be received within corresponding ones of the flutes 294. The flutes 294 and the rails 271 may, thus, have inverse contour, shape, etc. and may have a male-to-female configuration. During firing, the rails 271 and the intermediate surfaces 272 may deform to thereby seal against the inner surface 280. In some embodiments, the rails 271, the intermediate surfaces 272, and/or other portions of the sabot 212 may plastically (i.e., permanently) deform to create the temporary seal discussed above. As such, the projectile 214 may achieve the desired velocity and the spent cartridge 200 may be ejected in the blowback operation as discussed above.

Figure 7:
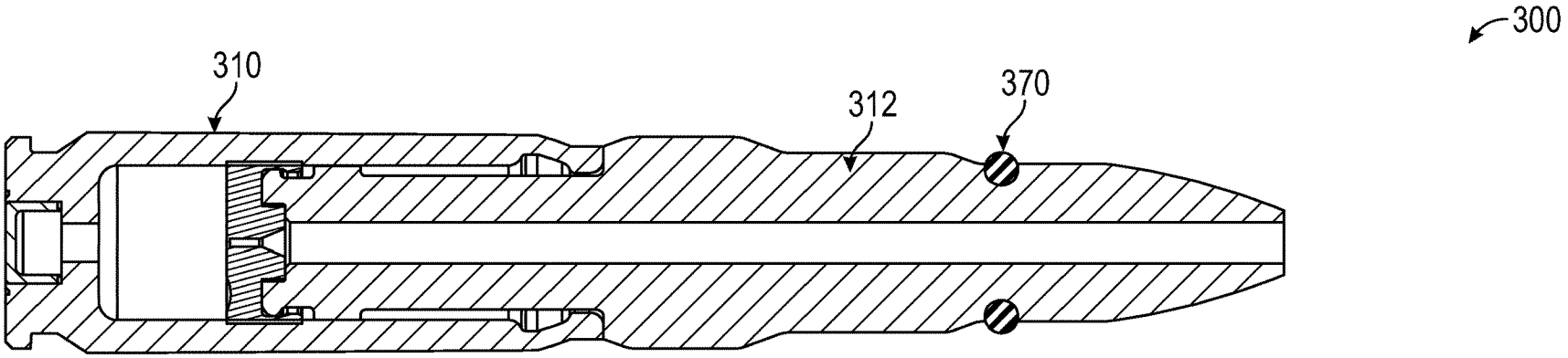
FIG. 7 is a longitudinal cross-sectional view of the reduced-energy cartridge according to additional example embodiments of the present disclosure.

Referring now to FIG. 7, the cartridge 300 is shown according to additional embodiments of the present disclosure. The cartridge 300 may be substantially similar to the embodiments discussed above except as noted. Components that correspond to those of FIGS. 1-4 are indicated by corresponding reference numbers increased by 200.

The cartridge 300 may include a case 310 and a sabot 312. The cartridge 300 may also include a sealing member 370. The sealing member 370 may be an O-ring, similar to the sealing member 170 of FIGS. 1-4. The sabot 312 may include a pointed end. The cartridge 300 may function as discussed above as a reduced-energy cartridge. However, the cartridge 300 may be configured as a blank cartridge (with no projectile).

Figure 8:
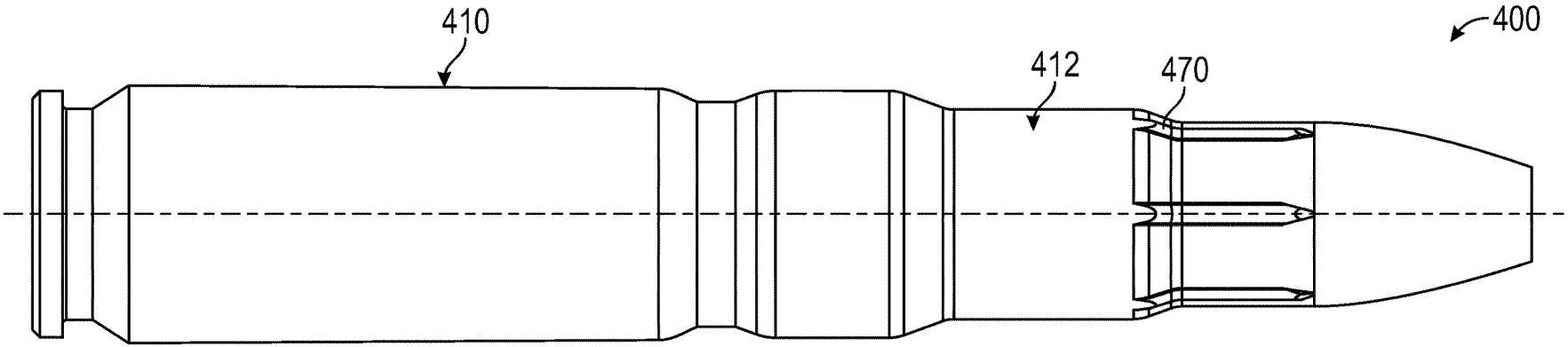
FIG. 8 is a longitudinal cross-sectional view of the reduced-energy cartridge according to additional example embodiments of the present disclosure.

Referring now to FIG. 8, the cartridge 400 is shown according to additional embodiments of the present disclosure. The cartridge 400 may be substantially similar to the embodiments discussed above except as noted. Components that correspond to those of FIGS. 1-4 are indicated by corresponding reference numbers increased by 300.

The cartridge 400 may include a case 410 and a sabot 412. The cartridge 400 may also include a sealing member 470. The sealing member 470 may include a plurality of elongate rails, similar to the sealing member 270 of FIGS. 5 and 6. The sabot 412 may include a pointed end. The cartridge 400 may function as discussed above as a reduced-energy cartridge. However, the cartridge 400 may be configured as a blank cartridge (with no projectile).

While at least one exemplary embodiment has been presented in the foregoing detailed description of the disclosure, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing an exemplary embodiment of the disclosure. It being understood that various changes may be made in the function and arrangement of elements described in an exemplary embodiment without departing from the scope of the disclosure as set forth in the appended claims.

What is claimed is:

1. A reduced-energy cartridge for a chamber of a firearm comprising:

a case;

a sabot with a first end and a second end that are separated along a longitudinal axis, the first end attached to the case to cooperatively define an internal combustion chamber with the case, the sabot moveably attached to the case and supported for movement relative to the case from an unfired position to a fired position resulting from combustion within the combustion chamber, the second end extending from the case along the longitudinal axis to define an exterior surface of the cartridge for facing the chamber in the unfired and fired positions, the exterior surface including a datum taper with a taper end, the datum taper tapering downward in radius as the datum taper extends in a forward direction along the longitudinal axis from the taper end toward the second end; and a sealing member that is provided on the second end of the sabot to partly define the exterior surface, the sealing member projecting radially outward from the longitudinal axis and from the sabot, the sealing member defining a blowback boundary where the cartridge is configured to seal against an inner surface of the chamber of the firearm, a forward area of the cartridge and a rear area of the cartridge being separated by the blowback boundary, the sealing member configured for releasably sealing against the inner surface of the chamber to regulate pressure at the forward area resulting from combustion within the combustion chamber, the sealing member being disposed at least partly in the forward direction from the datum taper, the sealing member having an outer radius that is greater than that of the datum taper at the taper end.

2. The cartridge of claim 1, wherein the sealing member is a toric sealing member.

3. The cartridge of claim 2, wherein the sabot includes a continuous groove that extends continuously about the longitudinal axis; and wherein the groove receives the sealing member.

4. The cartridge of claim 1, wherein the sealing member includes an elongate rail that extends along the longitudinal axis.

5. The cartridge of claim 1, wherein the sabot and the case are made from an aluminum-based material.

6. The cartridge of claim 1, wherein the sealing member is resiliently flexible.

7. The cartridge of claim 1, further comprising a projectile that is removably attached to the second end of the sabot.

8. The cartridge of claim 1, wherein the reduced-energy cartridge is configured as a blank cartridge.

9. The cartridge of claim 1, wherein the sealing member includes a plurality of elongate rails that extend along the longitudinal axis, the plurality of elongate rails spaced apart circumferentially about the longitudinal axis; and wherein the sabot and the plurality of elongate rails are integrally connected to define a unitary, polymeric body.

10. The reduced-energy cartridge of claim 1, wherein the exterior surface includes a second taper that is spaced apart along the longitudinal axis from the datum taper; and wherein the second taper tapers downward in radius as the second taper extends along the longitudinal axis toward the datum taper in the forward direction.

11. A method of manufacturing a reduced-energy cartridge for a chamber of a firearm, the method comprising:

attaching a first end of a sabot to a case to cooperatively define an internal combustion chamber with the case, including moveably attaching the sabot to the case and supporting the sabot for movement relative to the case from an unfired position to a fired position, the sabot including a second end that is separated from the first end along a longitudinal axis, the second end extending from the case along the longitudinal axis to define an exterior surface of the cartridge for facing the chamber in the unfired and fired positions, the exterior surface including a datum taper with a taper end, the datum taper tapering downward in radius as the datum taper extends in a forward direction along the longitudinal axis from the taper end toward the second end; and providing a sealing member on the second end of the sabot to partly define the exterior surface, the sealing member projecting radially outward from the longitudinal axis and radially outward from the sabot, the sealing member defining a blowback boundary where the cartridge is configured to seal against an inner surface of the chamber of the firearm, a forward area of the cartridge and a rear area of the cartridge being separated by the blowback boundary, the sealing member configured for releasably sealing against the inner surface of the chamber to regulate pressure at the forward area resulting from combustion within the combustion chamber, the sealing member being disposed at least partly in the forward direction from the datum taper, the sealing member having an outer radius that is greater than that of the datum taper at the taper end.

12. The method of claim 11, wherein the sealing member is a toric sealing member.

13. The method of claim 12, wherein providing the sealing member includes receiving the sealing member within a groove of the sabot, the groove extending continuously about the longitudinal axis.

14. The method of claim 11, wherein the sealing member includes an elongate rail that extends along the longitudinal axis.

15. The method of claim 11, wherein the sabot and the case are made from an aluminum-based material.

16. The method of claim 11, wherein the sealing member is resiliently flexible.

17. The method of claim 11, wherein the exterior surface includes a second taper that is spaced apart along the longitudinal axis from the datum taper; and wherein the second taper tapers downward in radius as the second taper extends along the longitudinal axis toward the datum taper in the forward direction.

18. A reduced-energy cartridge for a chamber of a firearm comprising:

a case;

a sabot including a first end and a second end that are separated along a longitudinal axis, the sabot including a combustion passage extending longitudinally between the first end and the second end, the first end attached to the case to cooperatively define an internal combustion chamber with the case, the first end supported for movement relative to the case from an unfired position to a fired position resulting from combustion within the combustion chamber, the second end extending from the case along the longitudinal axis to define an exterior surface of the cartridge for facing the chamber in the unfired and fired positions, the second end having a frustoconic datum taper with a taper end, the datum taper tapering downward in radius as the datum taper extends in a forward direction along the longitudinal axis from the taper end toward the second end; and a sealing member that is provided on the second end to partly define the exterior surface, the sealing member projecting radially outward from the longitudinal axis and radially outward from the sabot, the sealing member being resiliently flexible to define a blowback boundary where the cartridge is configured to resiliently flex and seal against an inner surface of the chamber of the firearm, a forward area of the cartridge and a rear area of the cartridge being separated by the blowback boundary, the sealing member configured for resiliently flexing to releasably seal against the inner surface of the chamber to regulate pressure at the forward area resulting from combustion within the combustion chamber, the sealing member being disposed in the forward direction and spaced apart at a distance from the datum taper with respect to the longitudinal axis, the sealing member having an outer radius that is greater than that of the datum taper at the taper end.

* * * * *